US006100866A

United States Patent [19]

Surguy

[11] Patent Number: 6,100,866

[45] Date of Patent: Aug. 8, 2000

[54] ADDRESSING OF LIQUID CRYSTAL DISPLAYS

[75] Inventor: Paul William Herbert Surguy, Hayes, United Kingdom

[73] Assignee: Central Research Laboratories, Middlesex, United Kingdom

[21] Appl. No.: 08/952,650

[22] PCT Filed: May 13, 1996

[86] PCT No.: PCT/GB96/01130

§ 371 Date: Feb. 24, 1998

§ 102(e) Date: Feb. 24, 1998

[87] PCT Pub. No.: WO96/37875

PCT Pub. Date: Nov. 28, 1996

[30] Foreign Application Priority Data

May 25, 1995 [GB] United Kingdom ..... 9510612

[51] Int. Cl.[7] ..... G09G 3/36

[52] U.S. Cl. ..... 345/94; 345/97; 345/208

[58] Field of Search ..... 345/87, 94, 95, 345/96, 97, 99, 208, 209, 210

[56] References Cited

U.S. PATENT DOCUMENTS 4,917,470 4/1990 Okada et al. .
5,047,757 9/1991 Bone et al. .
5,270,697 12/1993 Takeda ..... 345/96
5,684,501 11/1997 Knapp et al. ..... 345/94

FOREIGN PATENT DOCUMENTS

WO 92/02925 2/1992 WIPO .

OTHER PUBLICATIONS

SID International Symposium Digest of Papers, Boston, May 17–22, 1992, May 17, 1992, Society for Information Display, pp. 217–220, P.W. Ross et al. "Color Digital Ferroelectric LCDS for Laptop Applications".

*Primary Examiner*—Regina Liang
*Attorney, Agent, or Firm*—Evenson, McKeown, Edwards & Lenahan, PLLC

[57] ABSTRACT

A liquid crystal device of the kind in which individually addressable regions are settable to different optical states in response to drive waveforms is described. The waveforms are used to cause the material in different regions to remain set in its existing optical state or to change to another state in dependence upon data to be input to the device, and they are pulse-like in nature and of predetermined amplitude and duration. The operating speed of the device in response to said waveform is improved by causing the profile of the waveforms to depart from the usual squared profile. In one example, the waveforms are caused to have substantially triangular leading and/or trailing edges and the profile causing the material to remain set in its existing optical state differs from that causing the material to change into another optical state.

9 Claims, 6 Drawing Sheets

ADDRESSING OF LIQUID CRYSTAL DISPLAYS

BACKGROUND AND SUMMARY OF THE INVENTION

This invention relates to the addressing of liquid crystal displays (LCDs) of the kind in which ferroelectric liquid crystal material is provided in a thin layer between respective front and back supports. Usually these supports are transparent, to allow the display to be back lit, and each carries a respective array of transparent, linear conductors. Conveniently, though not necessarily, the conductors carried by the two supports comprise mutually orthogonal arrays, in row and column configuration, of individually energisable conductors.

Each intersection of a row and a column conductor defines an individual picture element (pixel) of the display, each of which pixels can be caused to assume one or the other of two different and stable conditions by the simultaneous application, to the relevant row and column conductors, of appropriate voltage waveforms.

In practice, it is usual to apply a conditioning (or so-called "strobe") waveform in turn to the row conductors carried by one of the supports and to apply data signals, indicative of the information to be displayed, in parallel and on a line-by-line basis, to the column conductors. Various expedients, including non-sequential addressing of rows and the duplication of column conductors to allow more than one row of data to be applied at once to the display, are used however to achieve practical displays capable of refreshment at rates sufficiently high to avoid flicker.

It is also usual to apply to each row conductor, at some time prior to the application of each strobe signal thereto, a blanking pulse which sets all pixels on the row into one of the two stable conditions. Thus, the data signal in each case has to provide, when combined with the strobe waveform, a combined waveform which either switches the pixel to its other stable state or leaves it in the state to which the blanking pulse set it. Thus the data signals are not so much 'on' and 'off' signals as 'change' or 'no change' indications.

It will be appreciated that the liquid crystal material affects light transmitted through or reflected from it in different ways depending upon the stable condition in question and thus that the overall display can be caused to affect, on a pixel-by-pixel basis, light transmitted through or reflected from it and that, because the pixels are conditioned in accordance with the information to be displayed, a two-dimensional display of the required information is achieved.

As is well known, polarised sheets are used to enable the distinction between the two states in optical terms to be seen, or at least to emphasise the contrast between those live states. It is also known that various expedients can be used to enable the display to exhibit colour and grey-scale.

The present invention is concerned primarily with the voltage waveforms used to address and condition the respective pixels and represents a significant departure from the practices that have been employed since the discovery of the ferroelectric effect in liquid crystal materials. It has as one objective to increase the operating speed of ferroelectric liquid crystal devices.

It has the further objective of reducing the voltages applied across the liquid crystal material, since there is merit in doing this both from the standpoint of ensuring that the switching activity of the liquid crystal material is not slugged or otherwise adversely affected by the application of voltages which are greater than necessary, and also because the cost of circuitry to generate the necessary waveforms for application across the liquid crystal material is substantially reduced.

A method of addressing the ferroelectric liquid crystal display which has been proved particularly beneficial is described in European patent No 306203. This method though not essential, is preferred for use with the present invention because the discrimination between switching and non-switching functions is particularly efficient.

A particular characteristic of this method is the fact that a voltage pulse for application to an individual pixel, which (as mentioned previously) is made up by the combination of voltages applied to respective elements of the two sets of conductors which sandwich the liquid crystal device, has to be of relatively low amplitude to cause switching and relatively high amplitude to leave a pixel unswitched. This is called the inverse mode of operation.

There are many patents, patent applications and other publications which describe addressing and/or switching waveforms for use in ferroelectric liquid crystal devices. Typical examples can be found in UK Patent Nos GB 2173336 and GB 2173629.

All of the currently published waveforms, however are characterised by exhibiting rectangular or square wave profiles. The present invention, as will be understood, departs significantly from this practise.

According to the invention there is provided a liquid crystal device comprising liquid crystal material capable of assuming a plurality of optically distinguishable states, applicator means for addressing individually resolveable regions of said material and for applying thereto electrical drive waveforms capable of causing the material at each of the various regions to remain in the state assumed thereby prior to the application thereto of a drive waveform or to assume another of said states, in dependence upon the nature of data to be represented by said device, and conveyed thereto in said electrical waveforms, the drive waveforms being of pulse-like form and of predetermined amplitudes and duration, wherein the drive waveforms also exhibit variations in pulse profile, which variations significantly influence the liquid crystal material to remain in one of said states or to assume another of said states.

BRIEF DESCRIPTION OF THE DRAWINGS

In order that the invention may be clearly understood and readily carried into effect, one embodiment thereof will now be described, by way of example only, with reference to the accompanying drawings of which:

FIG. 5 shows Vt curves resulting from the use of the waveforms of FIG. 1 on a material with a more negative value of $\Delta E$ and a more positive $\delta\epsilon$ than the material which gave rise to the characteristics shown in FIG. 4 but in which the spontaneous polarisations and structure adopted by the molecules are similar.

DETAILED DESCRIPTION OF THE DRAWINGS

Figure 1:
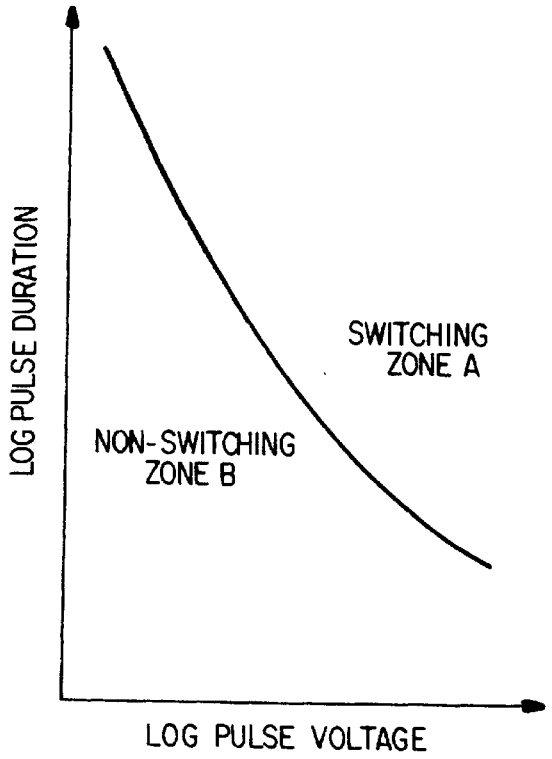
FIG. 1 PRIOR ART
FIGS. 1 and 2 are graphs taken from European Patent No 306203 (shown therein as FIGS. 2 and 4 respectively)
Figure 2:
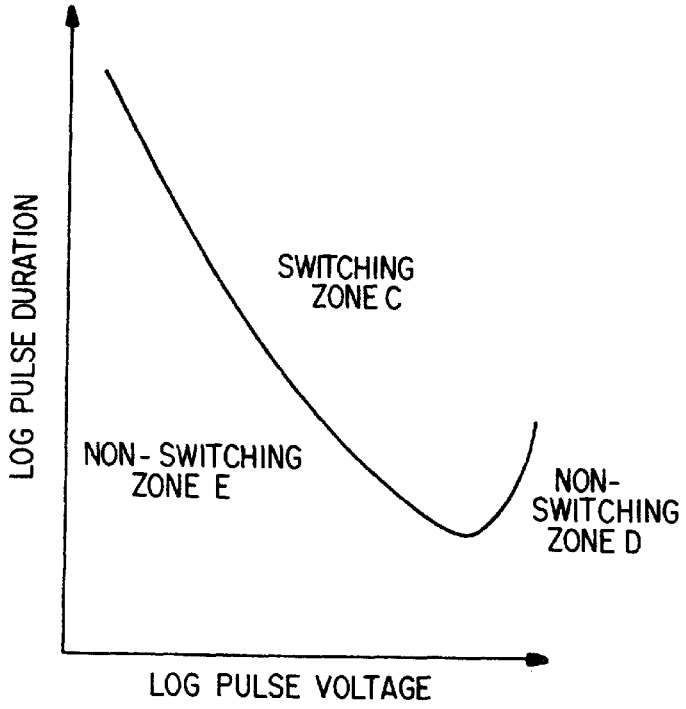
FIG. 2 PRIOR ART

Referring now to the drawings, FIGS. 1 and 2 are graphs taken from European Patent No 306203. They are used herein to indicate the distinction between the "normal" (FIG. 1) and "inverse" (FIG. 2) modes of operation. These graphs comprise logarithmic plots of time against voltage and are commonly known as "Vt characteristics". The reader's attention is invited to the aforementioned European Patent for further description of the characteristics and the pulse waveforms used therewith.

Figure 3A:
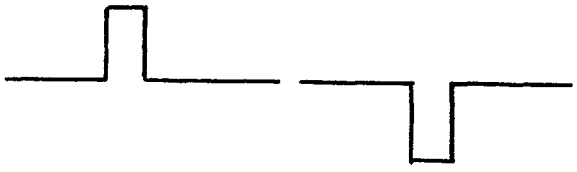
FIG. 3a PRIOR ART
FIGS. 3*a*–3*c* show simplified versions of waveforms that can be used in accordance with the invention together with conventional waveform of square profile for comparison purposes.
Figure 3B:
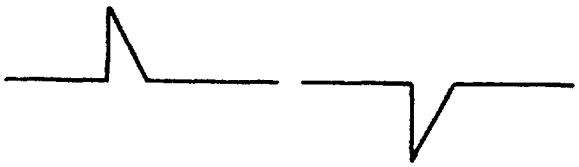
Figure 3C:
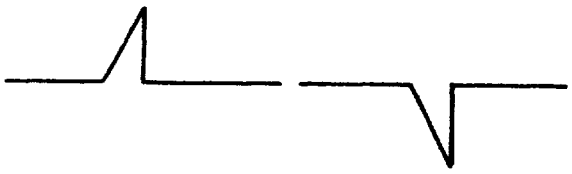
Figure 4:
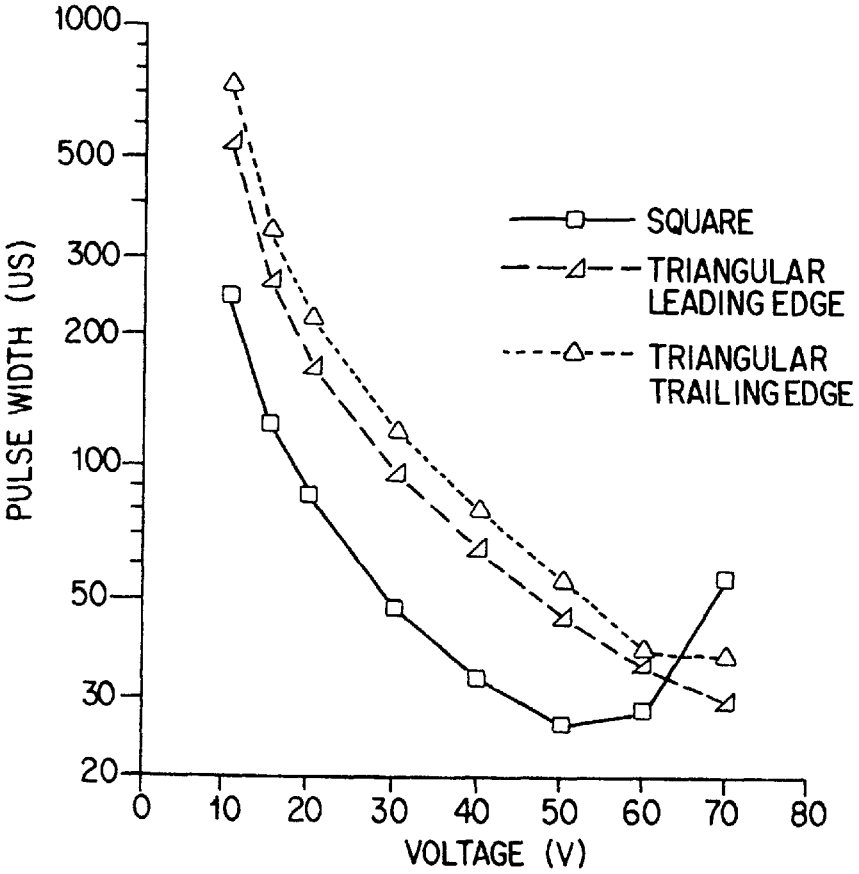
FIG. 4 shows Vt curves resulting from the use of the waveforms of FIG. 1 and a material with a negative value of $\Delta E$, and a positive value $\delta\epsilon$.

This invention is intended for operating in the region near to the minimum in the Vt characteristic, but functions best in the inverse mode. It exploits the differing response of ferroelectric liquid crystal devices (FLCDs) to waveforms of differing profiles. In this example, the difference between triangular and the conventional square waveforms is considered. This is illustrated in FIGS. 3*a*–3*c* and 4, with FIG. 3*a*–3*c* showing different waveforms that can be applied. FIG. 3*a* shows the conventional square edged pulses, whereas FIG. 3*b* shows pulses with triangular trailing edges and FIG. 3*c* shows pulses with triangular leading edges. The Vt characteristic of each of these, as applied to a particular liquid crystal cell, is shown in FIG. 4.

Figure 5:
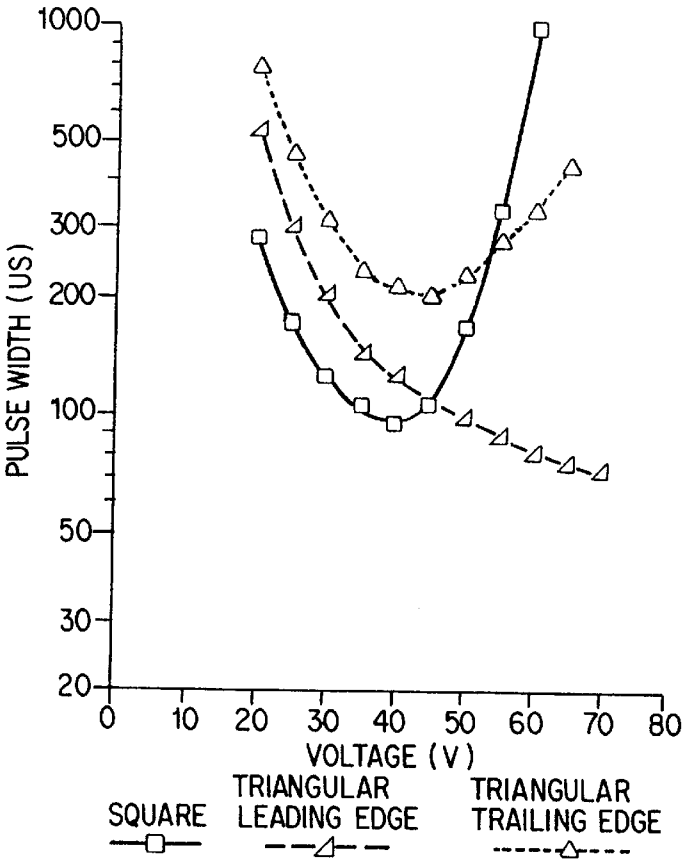

It will be observed that the response of ferroelectric liquid crystal material to a leading edge triangular waveform differs from its response to a trailing edge triangular waveform and differs yet again from its response to a waveform of square or rectangular profile. Not all ferroelectric liquid crystal materials exhibit this differing response to the pulse shape, and there is a dependence on the relative magnitude of the dielectric anisotropies and the spontaneous polarisation, as well as a particular structure adopted by the liquid crystals molecules within the device. For comparison, Vt characteristics for a material of different dielectric properties are shown in FIG. 5.

Referring in more detail to FIG. 4, it will be seen that the Vt characteristics associated with the waveforms having triangular leading or trailing edges do not indicate, at least on the scale shown, the distinct upturn that is associated with the characteristic for square wave pulses. This is used to advantage, as will be described in relation to FIGS. 6 and 7, which show how the aforementioned response to triangular pulses can be used to good effect into multiplexing schemes.

Figure 6:
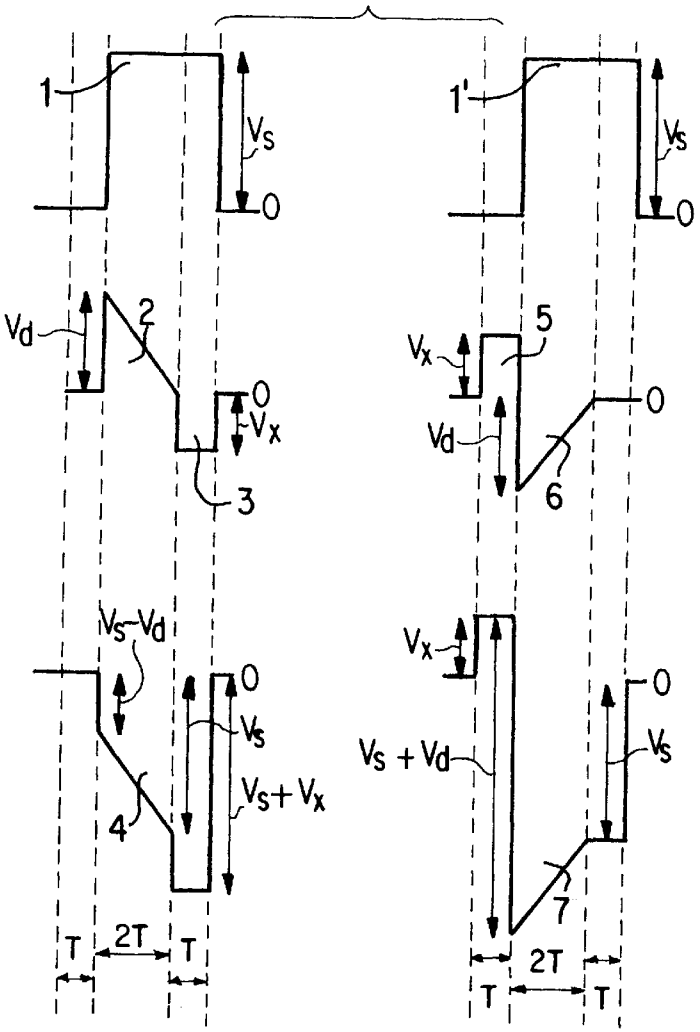
FIG. 6 shows an inverse mode multiplexing scheme using triangular pulses.

FIG. 6 shows in its left hand column, the strobe (of square wave profile) and of magnitude $V_S$. This pulse is designated 1 in the drawing.

Immediately beneath the strobe pulse and synchronised in timing therewith as indicated is shown the data change pulse. This as can be seen comprises a zero portion for a first period T followed by a rise to a voltage amplitude $V_d$. The voltage of this pulse then drops linearly to zero over a period of duration 2T, and is succeeded by a small negative pulse of duration T, amplitude Vx and square wave profile. The overall pulse thus consists of a saw tooth-like portion 2 and a square wave like portion 3.

When simultaneously applied to a row and column waveform respectively intersecting at a given pixel of the FLCD, the strobe and change waveforms combine to produce an operating waveform shown immediately below the change waveform and synchronised in timing therewith as shown. The effect of combining the two pulses is as shown and it will be observed that the strobe pulse 1 has been in effect inverted and added to the change pulse 2, 3. This produces the composite switching pulse 4 as shown which in terms of its overall effect on the pixel is like a waveform with a triangular leading edge.

The right hand column of FIG. 6 shows in similar fashion a strobe pulse $\mathbf{1}^1$, a non changing pulse which is the inverse of the pulse 2, 3 and comprises a small positive going square waveform of amplitude Vx shown at 5 and a negative saw tooth-like portion 6.

The combination of the non change pulse 5, 6 with the strobe pulse $\mathbf{1}^1$ produces the complex drive waveform for the non change condition as shown in the lower diagram of the right hand column of FIG. 6. This complex waveform 7, as applied across a pixel, has a similar driving characteristic to a waveform of square profile. Thus, referring back to FIG. 4, it can be seen that the resultant change waveform 4, being of generally triangular leading edge in nature, needs only to remain beneath the relevant curve as shown in FIG. 4 to effect switching of the relevant pixel. The complex waveform 7 for non switching, on the other hand, being of generally square wave nature, merely has to remain to the right hand side of the upturn on the relevant curve for a square waveform. This means that the two pulses 4 and 7 can actually be quite close in overall magnitude, their different effects on the pixel being achieved by the shapes of their respective waveforms, or rather the effects of these shapes on the liquid crystal material in the vicinity of the pixel.

In the event that the circumstances are such that the complex drive waveform 7 appears to the liquid crystal material in the vacinity of the pixel as a triangular trailing edge pulse rather than a pulse of square waveform the invention still operates advantageously, because the non change waveform 7 merely has to exceed the relevant curve for the triangular trailing edge, which can be done at relatively low voltage and relatively low pulse width.

Figure 7:
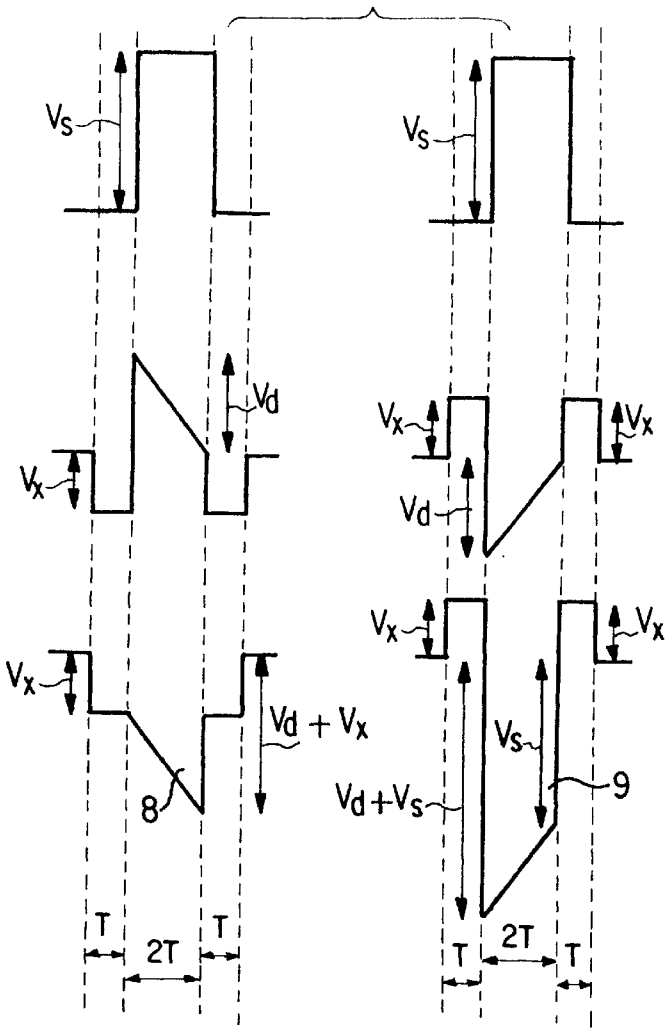
FIG. 7 shows a variant of the inverse mode multiplexing scheme shown in FIG. 6.

FIG. 7 shows, in similar layout and with similar timing sychronisations to the waveform shown in FIG. 6, a different arrangement of change data pulse and unchanged data pulse and correspondingly a different overall pulse driving arrangement as indicated by the two lower waveforms which are the composite of the strobe and data drive waveforms applied to a pixel.

The left hand waveform 8 has generally the characteristic of a triangular leading edge waveform, whereas the right hand composite waveform 9 has generally the characteristics of a square waveform or a triangular trailing edge waveform, depending on how the circuits and the material respond thereto.

It will be appreciated that many different combinations of strobe and data waveforms can be contrived to achieve individual desired objectives in different circumstances, and the invention is not considered limited to the particular schemes shown in FIGS. 6 and 7. In some circumstances, it can be advantageous to modify the profile of the strobe pulse instead of or as well as those of the data pulses.

It will be appreciated therefore, that in these examples of the invention, the fact that some ferroelectric liquid crystals switch more readily in response to a leading edge triangular pulse as compared to a trailing edge triangular pulse may be used to advantage in order to selectively turn on a pixel in an LCD.

A leading edge triangular pulse can, at high voltages (see FIG. 4), even be used to switch faster than a square pulse. This is more remarkable when it is considered that the area under the square pulse is roughly double that of the triangular pulse. This means that the FLCD can be driven more quickly using these types of pulses than those of square waveform used in the prior art.

Figure 8:
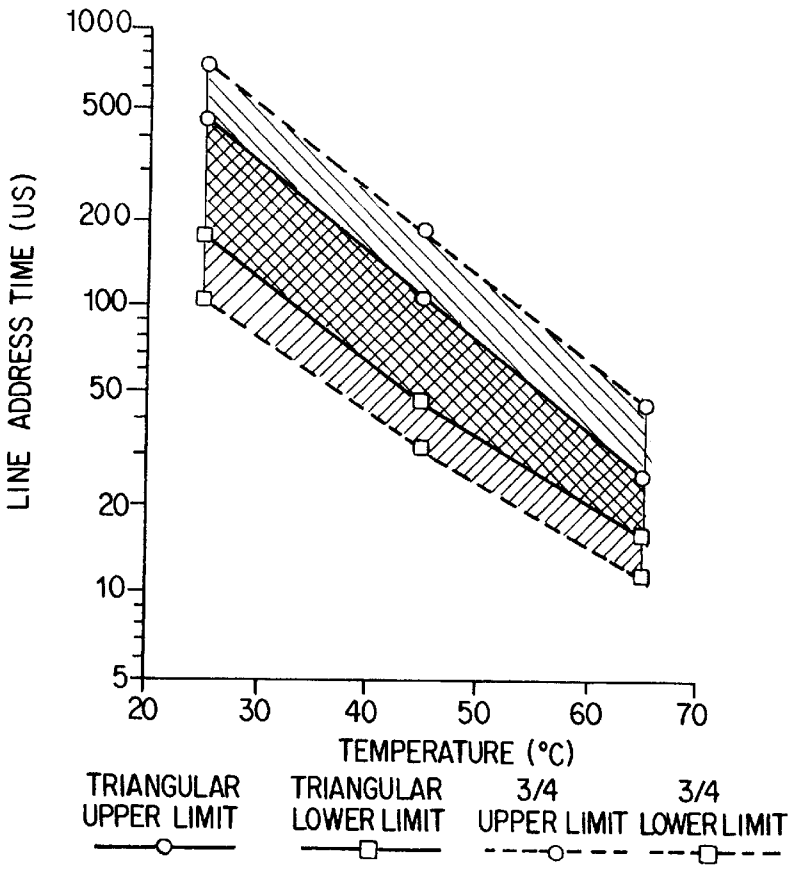
FIG. 8 is a graph showing operating temperature range and speed of the triangular multiplexing scheme of FIG. 7 compared to that of the prior art.

FIG. 8 shows the operating temperature range of the scheme shown in FIG. 6 in comparison with that of one of the best of the prior art techniques. It will be seen that in general line address times are faster at lower temperature for schemes utilising triangular leading and/or trailing edge pulses.

The pulse profiles described hereinbefore are designed to operate in the inverse mode (i.e. the larger pulse does not change the pixel's state while the smaller magnitude pulse does change it), but modulation of the shape of the data pulses and/or the strobe pulse to produce composite pulses of differing profiles can equally be applied to operation in the normal mode. Such a normal mode arrangement is illustrated in FIG. 9, which is of similar format to FIGS. 6 and 7, with the temperature operating range being shown in FIG. 10.

Figure 11:
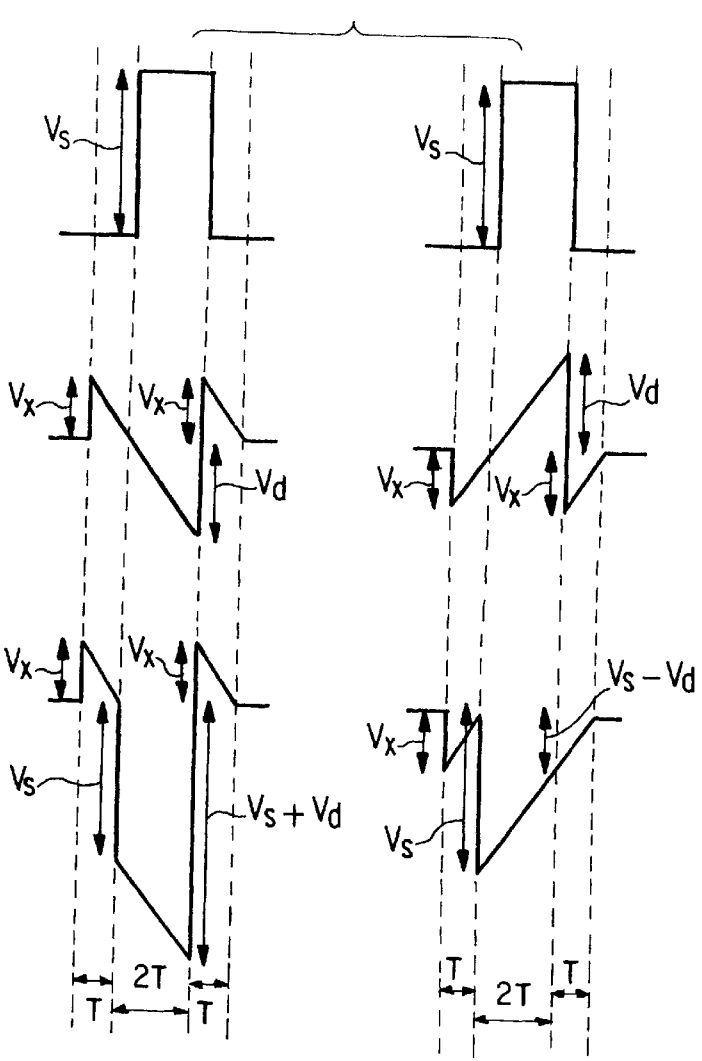
FIG. 11 shows another example of a normal mode multiplexing scheme using triangular pulses.
Figure 9:
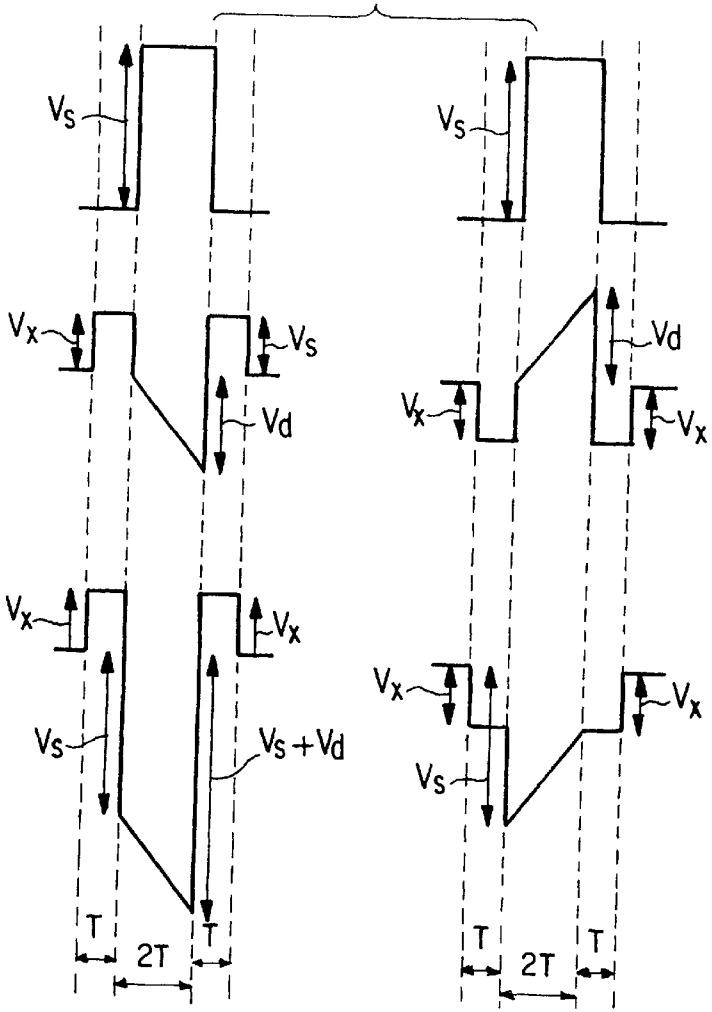
FIG. 9 shows a normal mode multiplexing scheme using triangular pulses.
Figure 10:
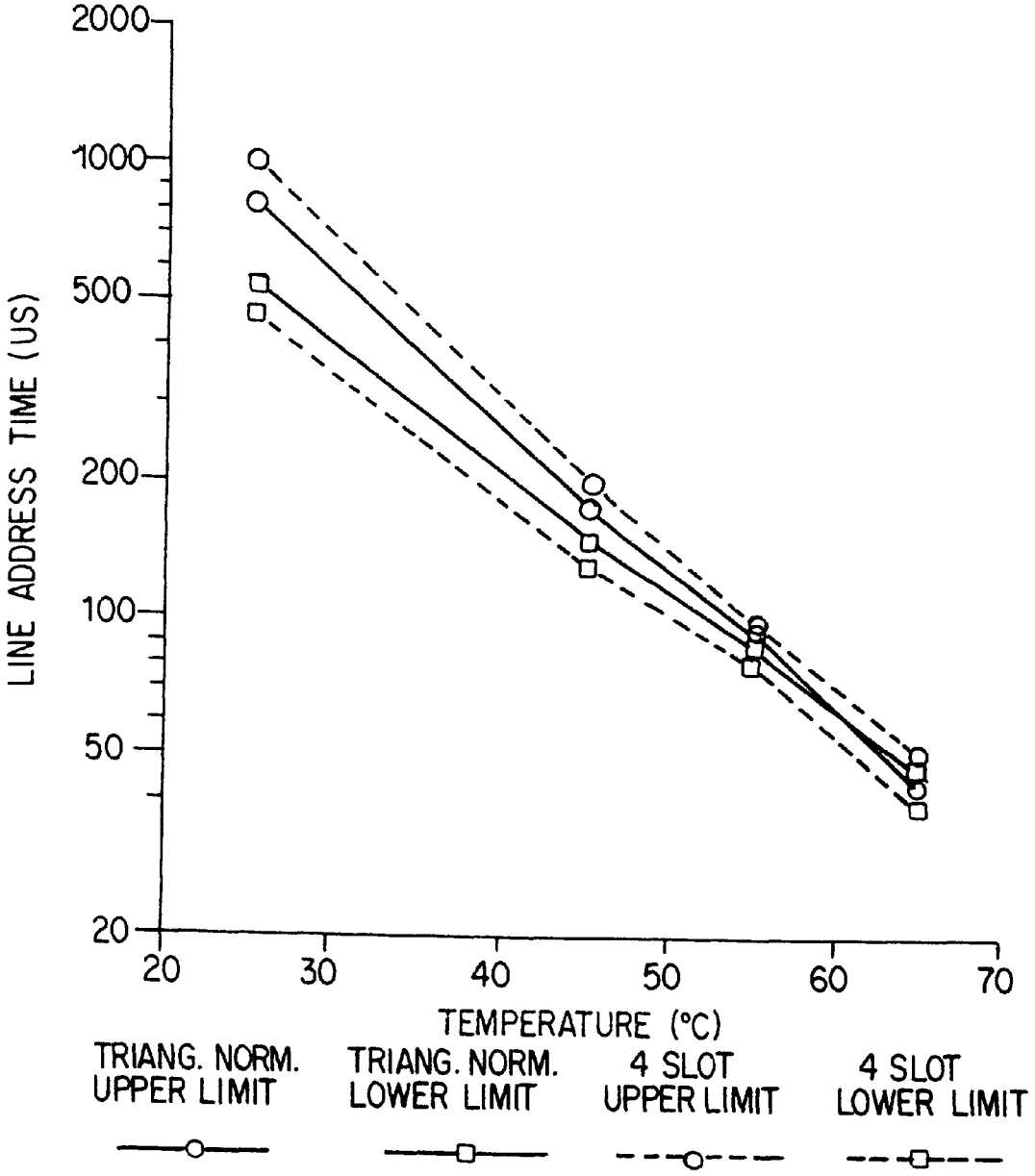
FIG. 10 is a graph showing the operating range of the normal mode scheme of FIG. 9 compared to the same scheme where the edges of the pulses are not modulated.

With reference to FIG. 9, it can be seen that the respective operating voltages applied across the pixel, which are shown in the lower right and lower left segments of the drawing, are of similar nature but of triangular trailing edge and triangular leading edge nature respectively. FIG. 11 shows again in similar layout, an alternative arrangement of data pulse and strobe pulse relationship for use in the normal mode.

Again, many different arrangement may be contrived for operation in the normal mode without departing from the scope of this invention.

The new waveforms provided by the invention and addressing schemes using them can be used with "conventional" blanking pulses of square waveform profile or with leading edge triangular blanking pulses. Leading edge triangular blanking pulses offer advantages in certain circumstances since there is a reduced area under the curve as compared with the equivalent prior art square shaped blanking pulses. This makes DC compensation of the strobe easier. Equally, the invention may be applied to addressing schemes in which there is no blanking, and where the strobe pulse reverses polarity on alternate addressing of the display. With these schemes, two full frames (one of each polarity) are required to completely re-write the display. These techniques are known for example from the two British patents referred to earlier in this specification.

What is claimed is:

1. A liquid crystal device comprising liquid crystal material which exhibits an inverse mode behavior and is capable of assuming a plurality of optically distinguishable states, applicator means for addressing individually resolvable regions of said material and for applying thereto, electrical drive waveforms capable of causing the material at each of the various regions to remain in the state assumed thereby, prior to the application thereto of a drive waveform, or to assume another of said states, in dependence upon the nature of data to be represented by said device and conveyed thereto in said electrical waveforms, the drive waveforms being of pulse-like form and of predetermined amplitudes and duration, wherein the drive waveforms also exhibit variations in pulse profile and comprise a substantially triangular leading edge to said drive waveform, which variations significantly influence the liquid crystal material to remain in one of said states or to assume another of said states.

2. A device according to claim 1 wherein said drive waveforms comprise composite waveform results from the application of strobe waveforms and data-carrying waveforms applied to the liquid crystal material via respective drive circuits and electrical conductors.

3. A device according to claim 2 wherein said variation in pulse profile are incorporated in said data-carrying waveforms.

4. A device according to claim 2 wherein said variations in pulse profile are incorporated in said strobe waveforms.

5. A device according to claim 1, caused to operate in the inverse mode as defined herein.

6. A device according to claims 1, caused to operate in the normal mode as defined herein.

7. A device according to claim 1, wherein blanking pulses are applied to said material to pre-condition it into a selected one of said states prior to the application of said drive waveforms.

8. A device according to claim 7 wherein the blanking pulses have substantially triangular leading and/or trailing edges.

9. A device according to claim 1, wherein the drive waveform has a triangular trailing edge.

* * * * *